US009375919B2

(12) United States Patent
Edamura et al.

(10) Patent No.: US 9,375,919 B2
(45) Date of Patent: Jun. 28, 2016

(54) INKJET PRINTING APPARATUS, INKJET PRINTING METHOD, AND NON-TRANSITORY COMPUTER-READABLE STORAGE MEDIUM

(71) Applicant: CANON KABUSHIKI KAISHA, Tokyo (JP)

(72) Inventors: Tetsuya Edamura, Inagi (JP); Tsukasa Doi, Kawasaki (JP); Katsuya Ogawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/832,946

(22) Filed: Aug. 21, 2015

(65) Prior Publication Data

US 2016/0052264 A1 Feb. 25, 2016

(30) Foreign Application Priority Data

Aug. 25, 2014 (JP) ..... 2014-170987

(51) Int. Cl.
*B41J 2/045* (2006.01)

(52) U.S. Cl.
CPC ..... *B41J 2/04551* (2013.01); *B41J 2/04586* (2013.01)

(58) Field of Classification Search
CPC ..... B41J 3/60; B41J 2/04551; B41J 2/04586; B65H 2801/06
See application file for complete search history.

(56) References Cited

U.S. PATENT DOCUMENTS

| | | | | |
|---|---|---|---|---|
| 7,185,962 | B2 * | 3/2007 | Takahashi | B41J 3/60 347/14 |
| 2009/0147039 | A1 | 6/2009 | Koase | |
| 2009/0244236 | A1 | 10/2009 | Houjou | |
| 2012/0194590 | A1 | 8/2012 | Suzuki | |
| 2014/0092162 | A1 | 4/2014 | Nishihara | |

FOREIGN PATENT DOCUMENTS

| | | | |
|---|---|---|---|
| JP | 2003-039652 | A | 2/2003 |
| JP | 2007-152787 | A | 6/2007 |
| JP | 2010-253726 | A | 11/2010 |

* cited by examiner

*Primary Examiner* — Thinh Nguyen
(74) *Attorney, Agent, or Firm* — Canon U.S.A., Inc. IP Division

(57) ABSTRACT

The inkjet printing apparatus uses a different scanning condition in printing for a unit region on the back side of a printing medium corresponding to a unit region on the front side of the printing medium where cockling is estimated to occur.

15 Claims, 15 Drawing Sheets

| | Single-sided Printing | | Double-sided Printing | |
|---|---|---|---|---|
| | Standard | High | Standard | High |
| Plain Paper | 1-pass | 5-pass | 1-pass | 5-pass |
| Post Card | 2-pass | 5-pass | 2-pass | 5-pass |
| Photo Paper | 5-pass | 7-pass | Not Available | Not Available |

91

| | | | | | |
|---|---|---|---|---|---|
| 140 | 120 | 120 | 0 | 0 | 90a |
| 60 | 80 | 50 | 30 | 10 | 90b |
| 50 | 60 | 20 | 0 | 0 | 90c |
| 110 | 100 | 150 | 90 | 110 | 90d |
| 80 | 80 | 80 | 90 | 90 | 90e |
| 80 | 140 | 110 | 90 | 90 | 90f |
| 50 | 50 | 40 | 30 | 20 | 90g |
| 0 | 0 | 40 | 60 | 20 | 90h |
| 80 | 90 | 50 | 70 | 80 | 90i |
| 100 | 80 | 40 | 90 | 60 | 90j |

| | |
|---|---|
| 140 | 90a |
| 80 | 90b |
| 60 | 90c |
| 150 | 90d |
| 90 | 90e |
| 140 | 90f |
| 50 | 90g |
| 60 | 90h |
| 90 | 90i |
| 100 | 90j |

| | |
|---|---|
| → | 90a' |
| → | 90b' |
| ← | 90c' |
| ← | 90d' |
| ← | 90e' |
| ← | 90f' |
| ← | 90g' |
| → | 90h' |
| ← | 90i' |
| → | 90j' |

INKJET PRINTING APPARATUS, INKJET PRINTING METHOD, AND NON-TRANSITORY COMPUTER-READABLE STORAGE MEDIUM

BACKGROUND OF THE INVENTION

1. Field of the Invention

The present invention relates to an inkjet printing apparatus, inkjet printing method, and non-transitory computer-readable storage medium.

2. Description of the Related Art

An inkjet printing apparatus that prints information by discharging ink while scanning a print head for discharging the ink across a printing medium is known in the art. One example of such an inkjet printing apparatus is an apparatus that prints information on a front side of a printing medium, then reverses the printing medium, and prints information on a back side of the printing medium, that is, an apparatus that executes so-called double-sided printing.

It is known that an inkjet printing apparatus may suffer a phenomenon in which a printing medium is made to wrinkle due to the application of ink to the printing medium, so-called "cockling". The occurrence of cockling increases with an increase in the amount of ink applied to the printing medium.

When cockling occurs in printing on a front side of a printing medium by the above-described inkjet printing apparatus capable of executing double-sided printing, the distance between the print head and the printing medium (hereinafter also referred to as head-to-medium distance) at the time of discharging ink to the back side changes. This may cause ink landing position deviation and lead to a decrease in image quality of a printed image. Japanese Patent Laid-Open No. 2007-152787 discloses a technique to suppress the decrease in image quality caused by cockling by calculating a drawing area for each of the front and back sides of one printing medium and, if the total of the drawing areas for each of the front and back sides is larger than a threshold, increasing the number of scans on a unit region in back-side printing.

Unfortunately, the disclosed method may have issues as detailed below.

FIGS. 1A to 1C are schematic diagrams for describing cockling when print data elements corresponding to images to be printed on a printing medium are different. FIGS. 1A to 1C illustrate cases where the image is printed by scanning a print head five times across a printing medium 3. Unit regions 81 to 85 indicate regions where the image is printed by the first to fifth scans, respectively. Each of the ratios illustrated in FIGS. 1A to 1C indicates a ratio of the number of pixel regions where pixels are formed by discharging ink to the number of pixel regions corresponding to pixels where ink can be discharged in each unit region (hereinafter also referred to as printing duty).

FIG. 1A schematically illustrates an image in which the printing duty in a divided section 83*b* is 100% and that in a divided section 83*a* and that in each of the unit regions 81, 82, 84, and 85 is 0%. The divided section 83*b* and the divided section 83*a* are included in the unit region 83, where the image is printed on the printing medium 3 by the third scan. The divided section 83*b* is on the downstream side in an X direction, and the divided section 83*a* is on the upstream side in the X direction. FIG. 1B schematically illustrates an image in which the printing duty in the divided section 83*b* is 20% and that in each of the other regions is 0%.

The printing duties in the regions other than the divided section 83*b* in each of the images illustrated in FIGS. 1A and 1B are all 0%, and no cockling occurs therein. Both images have substantially the same drawing area, which corresponds to the area of the divided section 83*b*. In the image illustrated in FIG. 1A, the printing duty in the divided section 83*b* is as high as 100%, and relatively large cockling may occur in the divided section 83*b*. Thus when the image illustrated in FIG. 1A is printed on the front side of the printing medium, ink landing position deviation may occur in a region of the back side that corresponds to the divided section 83*b* of the front side.

In the image illustrated in FIG. 1B, the printing duty in the divided section 83*b* is as relatively low as 20%, and cockling is not likely to occur in the divided section 83*b*. Accordingly, in the case where the image illustrated in FIG. 1B is printed on the front side, ink landing position deviation is not likely to occur in a region of the back side that corresponds to the divided section 83*b* of the front side. Even with substantially the same drawing area, when the amount of ink discharged partially to the front side is larger, cockling occurs more conspicuously and ink landing position deviation is more likely to occur in back-side printing.

FIG. 1C schematically illustrates an image in which the printing duties in divided sections 81*a* to 85*a* and 81*b* to 85*b* in the unit regions 81 to 85 in the printing medium 3 are all 10%.

In the image illustrated in FIG. 1C, the total of the printing duties for the printing medium 3 is 100% (=10%×10), which is the same as that for the printing medium 3 in the image illustrated in FIG. 1A. Because ink is discharged to all of the regions in the printing medium, the drawing area in the image illustrated in FIG. 1C is larger than that in each of the images illustrated in FIGS. 1A and 1B. However, the printing duty in each of the divided sections 81*a* to 85*a* and 81*b* to 85*b* is as low as 10%, and cockling is not likely to occur in any of the divided sections. When the image illustrated in FIG. 1C is printed on the front side, ink landing position deviation is not likely to occur in back-side printing. As is clear from FIGS. 1A and 1C, even when the amount of ink discharged to the front side of the printing medium (printing duty) is the same, the frequency of occurrence of cockling may differ and the likelihood of ink landing position deviation in back-side printing may also differ.

As described above, when the effect of cockling is determined based on the drawing area of an image to be printed or the total of the amounts of ink discharged to a printing medium, the occurrence of partial cockling may be unable to be accurately determined. Thus, for example, when the technique described in Japanese Patent Laid-Open No. 2007-152787 is used, an unnecessarily increased number of scans may decrease the throughput or an insufficient number of scans in printing for a divided section where partial cockling is likely to occurs and that needs an increased number of scans may lead to a decreased image quality.

SUMMARY OF THE INVENTION

The present invention provides printing that suppresses the effect of ink landing position deviation caused by the occurrence of partial cockling in double-sided printing.

An inkjet printing apparatus according to an embodiment of the present invention includes a print head, a scanning unit, a first print control unit, an acquiring unit, a determining unit, and a second print control unit. The print head includes nozzle rows each including a plurality of nozzles for discharging ink of an identical color arranged in a predetermined direction. The scanning unit is configured to scan the print head in a crossing direction that crosses the predetermined direction. The crossing direction does not necessarily cross the predetermined direction perpendicularly and may be a direction that crosses the predetermined direction at some angle. The first print control unit is configured to cause the print head to discharge ink to each of a plurality of unit regions in a first surface of a printing medium, the unit regions being arranged parallel to the crossing direction of the scanning unit, while causing the scanning unit to scan the print head. The acquiring unit is configured to acquire information about an amount of ink discharged to each of a plurality of divided sections of each of the plurality of unit regions on the first surface. The determining unit is configured to determine a scanning condition for each of the plurality of unit regions in a second surface, the second surface being a back side of the first surface of the printing medium, based on the information about the amount of ink discharged to each of a plurality of divided sections of each of the plurality of unit regions on the first surface. The second print control unit is configured to cause the print head to discharge the ink to each of the plurality of unit regions in the second surface in accordance with the determined scanning condition.

Further features of the present invention will become apparent from the following description of exemplary embodiments with reference to the attached drawings. Each of the embodiments of the present invention described below can be implemented solely or as a combination of a plurality of the embodiments or features thereof where necessary or where the combination of elements or features from individual embodiments in a single embodiment is beneficial.

DESCRIPTION OF THE EMBODIMENTS

A first embodiment of the present invention is described in detail below with reference to the drawings.

First Embodiment

Figure 1A:
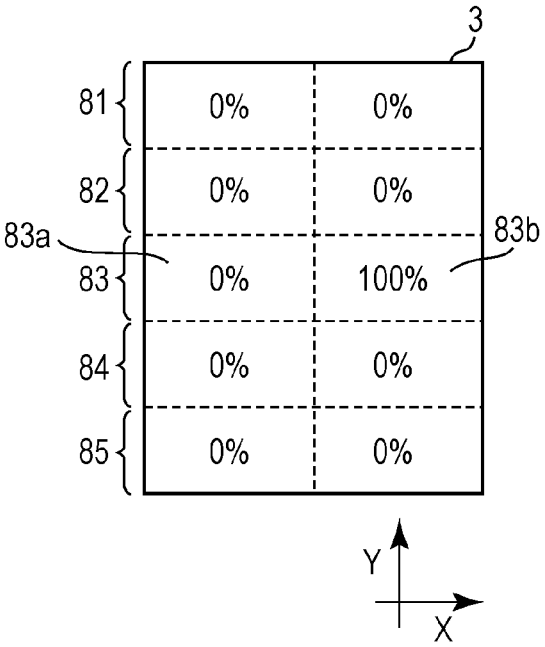
FIGS. 1A to 1C are schematic diagrams for describing partial cockling.
Figure 1B:
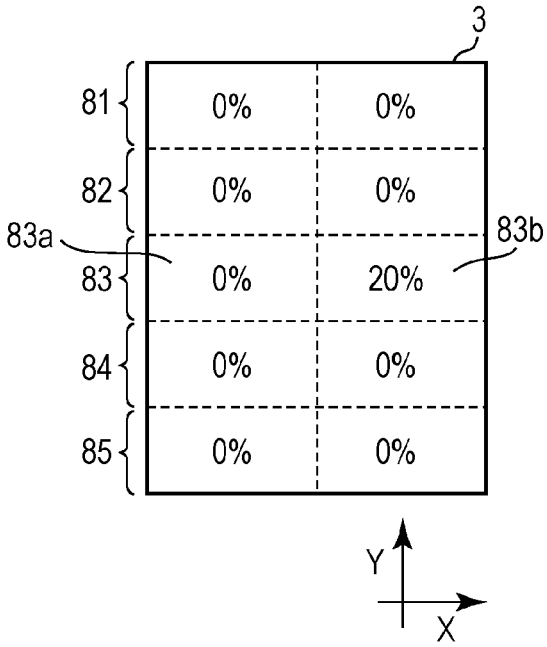
Figure 1C:
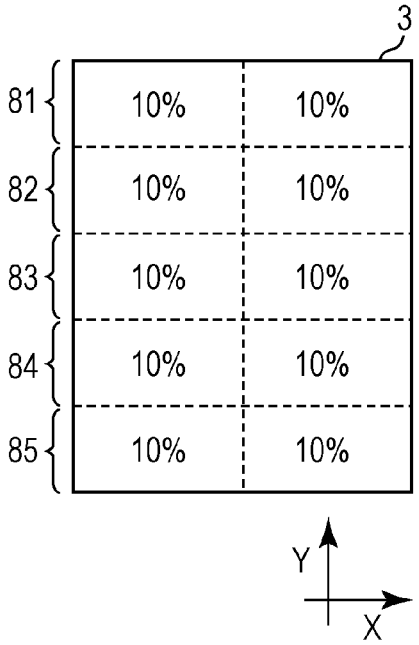
Figure 2:
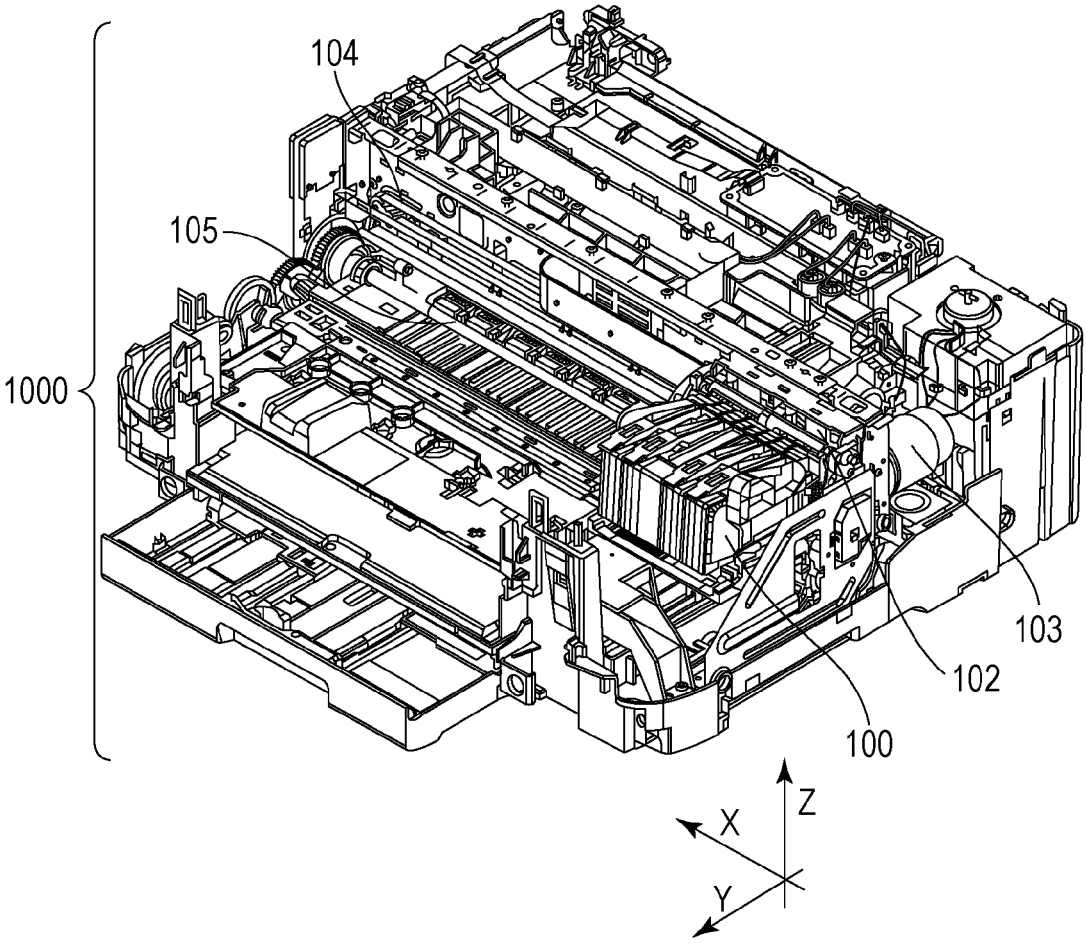
FIG. 2 is a perspective view of an inkjet printing apparatus according to an embodiment.

FIG. 2 is a perspective view that partially illustrates an internal configuration of an inkjet printing apparatus 1000 according to the present embodiment.

An interchangeable head cartridge 100 includes a print head 101 (illustrated in FIG. 3) for discharging ink described below and an ink tank for supplying the ink to the print head 101. The head cartridge 100 is detachably held on a carriage 102. The carriage 102 and the head cartridge 100 are scanned in a forward direction or backward direction along the X direction (crossing direction) by driving of a carriage motor 103. At this time, the driving force produced by the carriage motor 103 is transmitted to the carriage 102 through a carriage belt 104. During the reciprocating scan by the carriage 102, information is printed on the printing medium by discharging ink from the print head 101 in accordance with the print data (printing operation). While the printing operation is not performed, the printing medium is conveyed in the Y direction (conveyance direction), which crosses the X direction, by driving a conveyance roller 105 by a predetermined amount (conveying operation).

In the present embodiment, an image is printed on a printing medium by a plurality of scans of a repetition of such printing operations and conveying operations.

Figure 3:
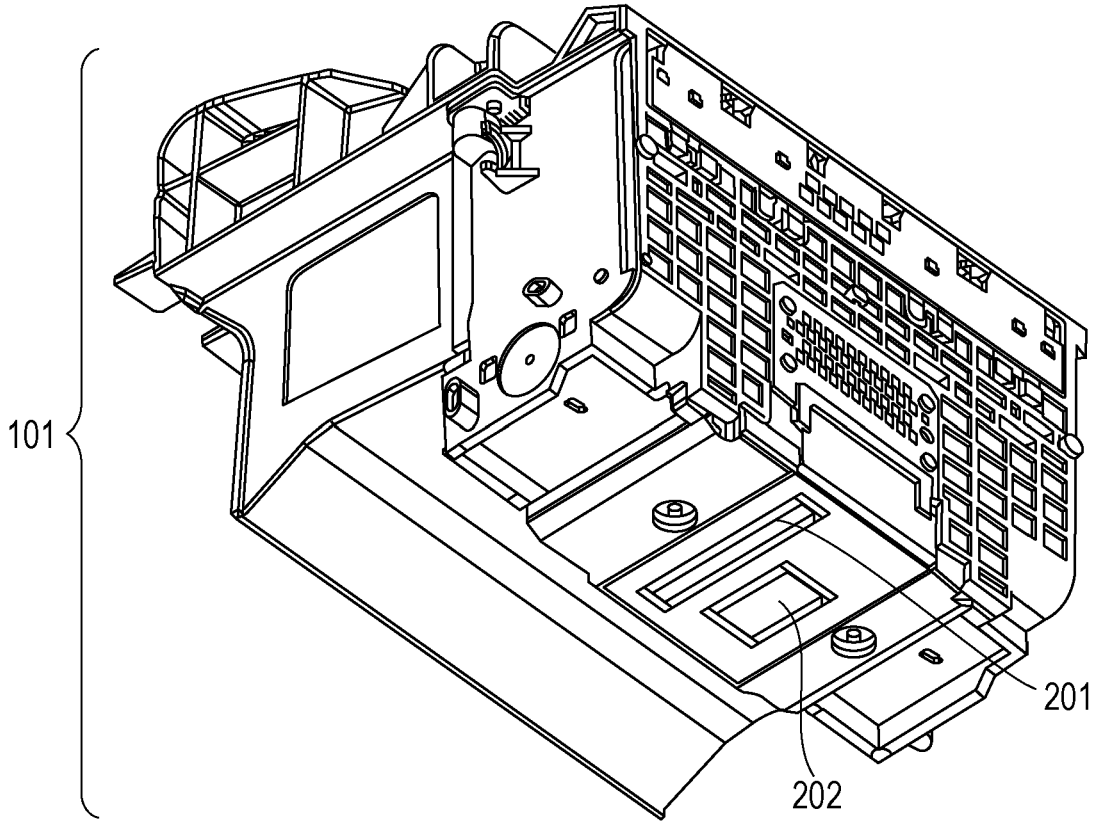
FIG. 3 is a perspective view of a print head according to the embodiment.
Figure 4:
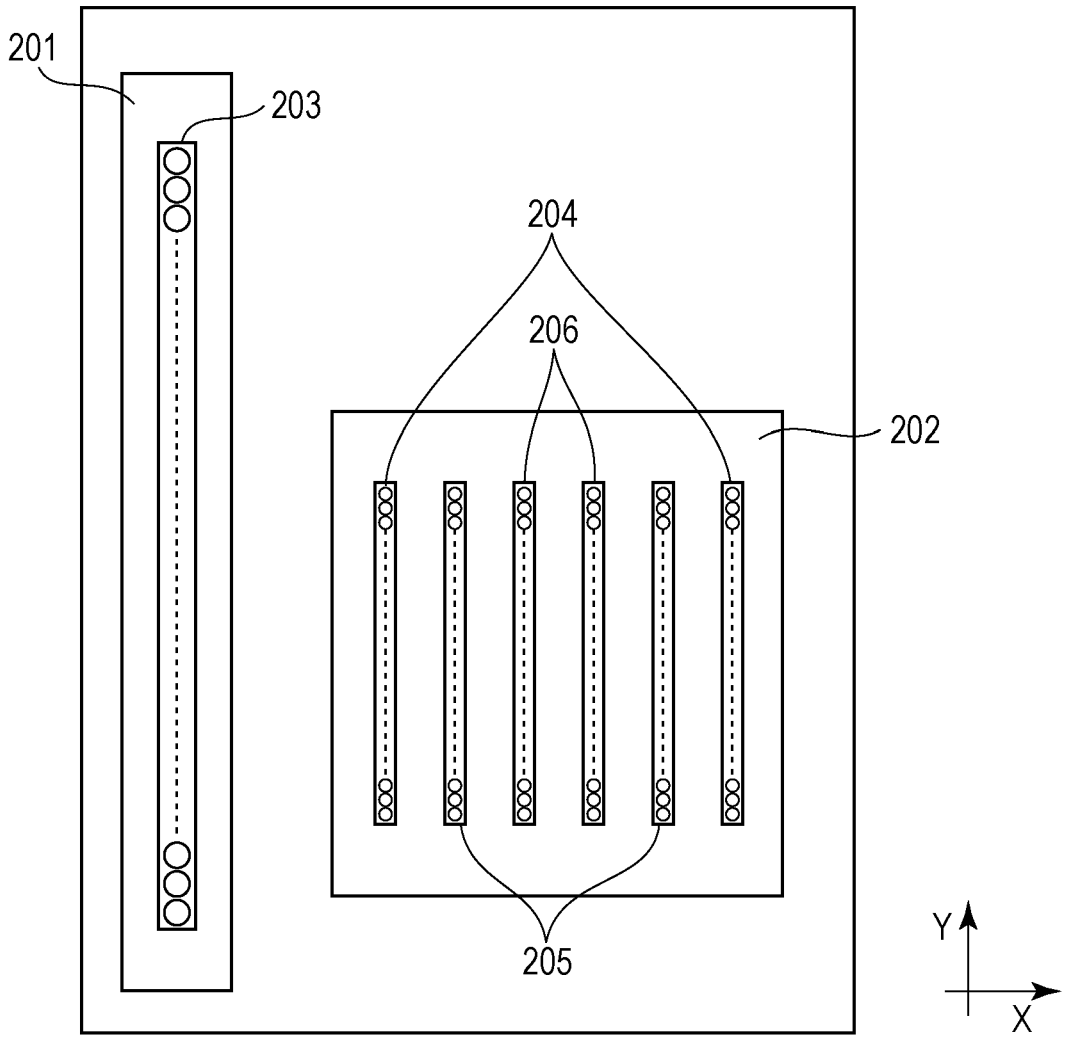
FIG. 4 is an enlarged view of the print head according to the embodiment.

FIG. 3 is a perspective view that illustrates the print head 101 according to the present embodiment. FIG. 4 is an enlarged view of chips 201 and 202 with nozzle rows on the print head according to the present embodiment.

As is clear from FIG. 3, in the present embodiment, the print chip 201 for discharging black ink (Bk chip) and the print chip 202 for discharging chromatic color ink (Cl chip) are disposed in the print head 101 as separate elements.

As further illustrated in FIG. 4, the Bk chip 201 has a Bk nozzle row 203 in which 1,280 nozzles for discharging the black ink are arranged in the Y direction (predetermined direction) at a printing resolution of 1,200 units per inch (corresponding to 1,200 dpi). The discharge amount for discharging the black ink for one nozzle is 12 ng. The Cl chip 202 has two C nozzle rows 204 each including 512 nozzles for discharging cyan ink arranged in the Y direction (predetermined direction) at a printing resolution of 1,200 units per inch (corresponding to 1,200 dpi). Similarly, the Cl chip 202 has two M nozzle rows 205 for discharging magenta ink and two Y nozzle rows 206 for discharging yellow ink. The discharge amount for discharging each of the cyan ink, magenta ink, and yellow ink for one nozzle is 6 ng. The two C nozzle rows 204 are near both ends in the X direction in the Cl chip 202. The two Y nozzle rows 206 are near the central portion in the X direction in the Cl chip 202. In the description below, the cyan ink, magenta ink, and yellow ink are also collectively referred to as chromatic color ink. In the description below, the six nozzle rows arranged in the Cl chip are also collectively referred to as Cl nozzle rows 204 to 206.

Figure 5:
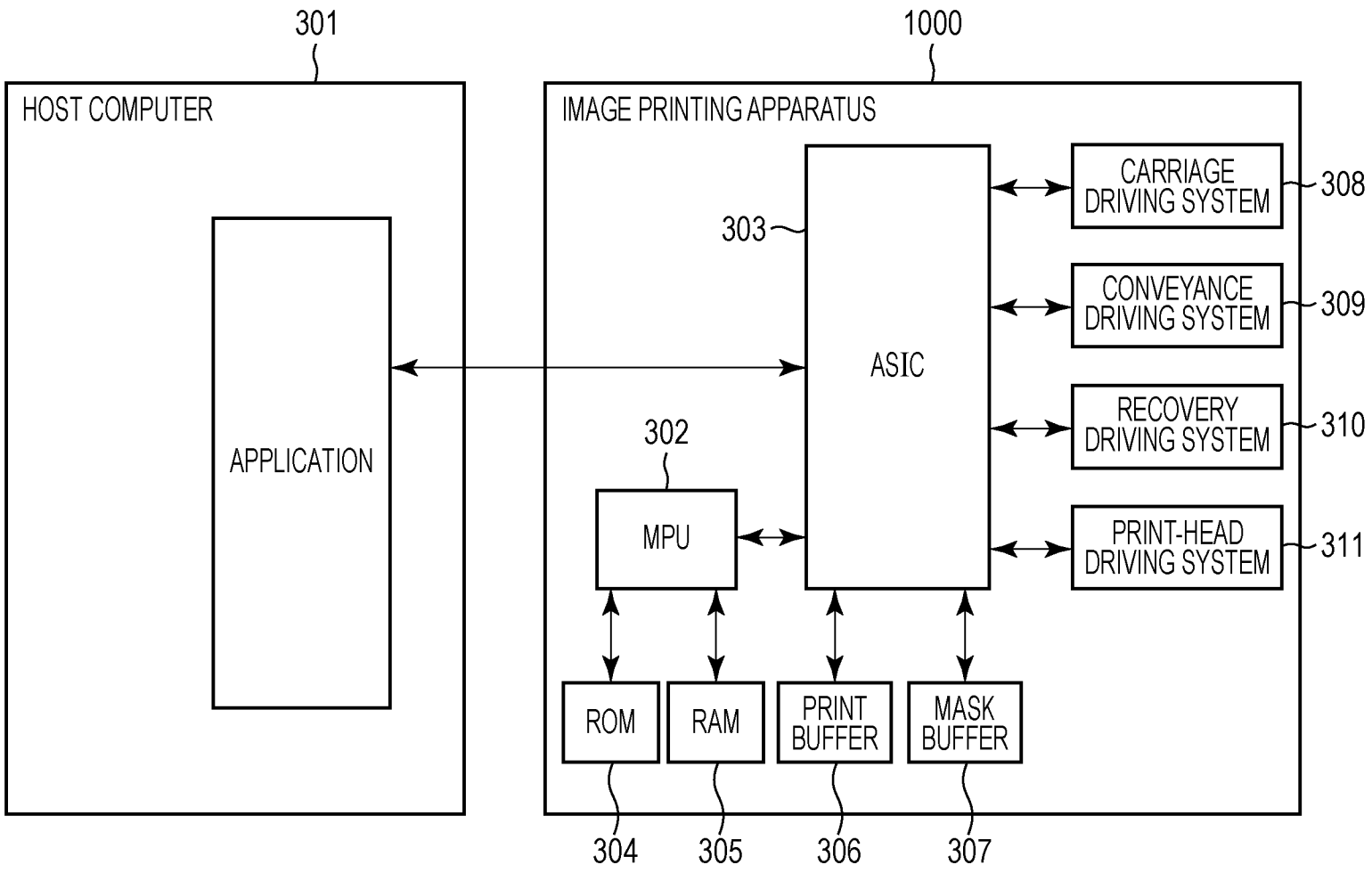
FIG. 5 is an illustration for describing a print control system according to the embodiment.

FIG. 5 is a block diagram that illustrates a schematic configuration of a print control system in the present embodiment.

A host computer 301 is an image inputting portion and is configured to transmit multivalued image data in RGB format stored in any of various kinds of storage media, including hard disk and memory, to an image processor in the printing apparatus 1000.

The image processor includes a microprocessor unit (MPU) 302 and an application-specific integrated circuit (ASIC) 303, which are described below. The multivalued image data can also be received from an external image input device, such as scanner or digital camera, connected to the host computer 301. The image processor is configured to generate binary image data by performing image processing on the input multivalued image data. In this way, the binary image data being print data for use in discharging ink from the print head 101 is generated.

The printing apparatus 1000 is an image outputting portion and is configured to print an image by applying ink to the printing medium 3 in accordance with ink binary image data generated by the image processor. The printing apparatus 1000 is controlled by the MPU 302 under a program stored in a read-only memory (ROM) 304. A random-access memory (RAM) 305 functions as a working area or temporary data storage area for the MPU 302. The MPU 302 controls a carriage driving system 308 for the carriage 102, a conveyance driving system 309 for the printing medium 3, a recovery driving system 310 for the print head 101, and a print-head driving system 311 for the print head 101 through the ASIC 303.

A print buffer 306 is configured to temporarily store print data converted into a format at which the data can be transferred to the print head 101.

A mask buffer 307 temporarily stores a plurality of mask patterns that can be applied when the print data is transferred to the print head 101. The plurality of mask patterns can be used when, among a plurality of printing modes described below, a printing mode at which data is printed by discharging with a plurality of scans of a print head for a unit region in a printing medium, that is, multi-pass printing method is executed. The plurality of mask patterns are prepared in the ROM 304. In actual printing, an appropriate mask pattern is read from the ROM 304, and it is stored in the mask buffer 307.

The present embodiment illustrates the form in which the image processor is included in the printing apparatus 1000. The image processor may be included in the host computer 301.

In the present embodiment, in accordance with a printing condition, one printing mode is selected from among a plurality of printing modes where the print head is scanned different numbers of times for a unit region in the printing medium, and the selected printing mode is executed. The printing modes executable in the present embodiment are described in detail below.

Figures 6, 7:
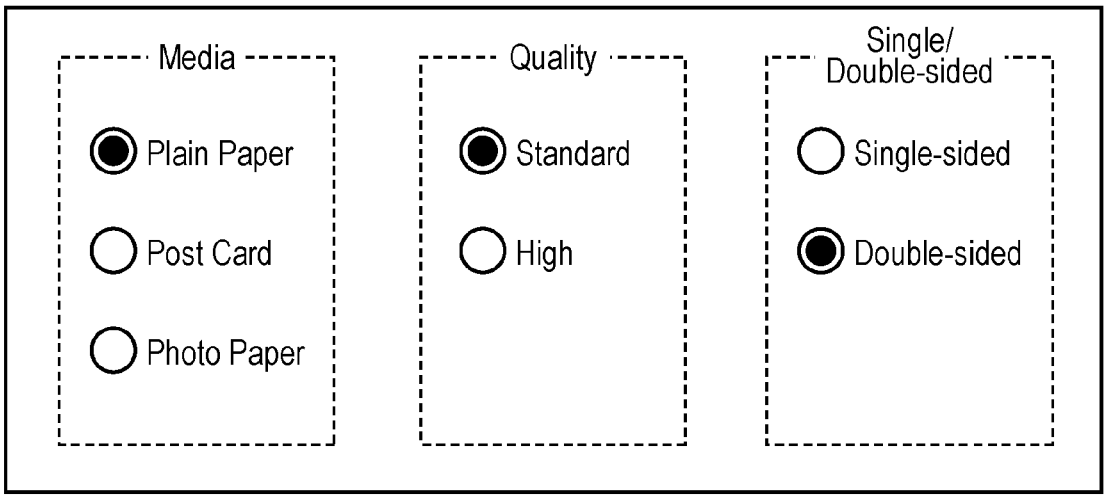
FIG. 6 schematically illustrates an interface screen on the printing apparatus according to the embodiment.
FIG. 7 is a table that illustrates a relationship between printing conditions and the numbers of scans according to the embodiment.

FIG. 6 schematically illustrates a part of an interface used to prompt a user to select a printing condition displayed on a display device in the host computer.

First, the inkjet printing apparatus in the present embodiment prints information in accordance with the type of the printing medium selected from among plain paper, post card, and photo paper by a user as the printing medium used in printing. The user can choose between the single-sided printing, in which data is printed on only one side of the printing medium, and the double-sided printing, in which data is printed on both sides of the printing medium. The user can also select the printing quality of an image to be printed between "standard" and "high." When the printing quality is "standard," the image can be printed at a speed higher than that when the printing quality is "high."

In the present embodiment, the number of scans of the print head for a unit region in the printing medium (hereinafter also referred to as number of passes) can be determined based on combination of information about the type of the printing medium printing quality, that about the printing quality, and that about the single-sided printing/double-sided printing.

FIG. 7 is a table that illustrates a method for determining the number of passes in accordance with a printing condition according to the present embodiment.

In the present embodiment, one, two, five, and seven can be set as the number of passes in accordance with information about the printing conditions. In the case where the printing medium used in printing is plain paper, in both double-sided printing and single-sided printing, the image is printed in one pass when the printing quality is "standard," and the image is printed in five passes when the printing quality is "high." Beading occurs more easily in post cards than in plain paper. Therefore, when the printing medium is a post card and the printing quality is "standard," the image is printed in two passes, which is a relatively increased number of passes. When the printing medium is a post card and the printing quality is "high," the image is printed in five passes. Beading occurs more easily in photo paper than in post cards, and a further increased number of passes is used for photo paper. Specifically, in the case where the printing medium is photo paper, the image is printed in five passes when the printing quality is "standard," and the image is printed in seven passes when the printing quality is "high." In the case where the printing medium is photo paper, the double-sided printing is set to be unavailable.

Figure 8A:
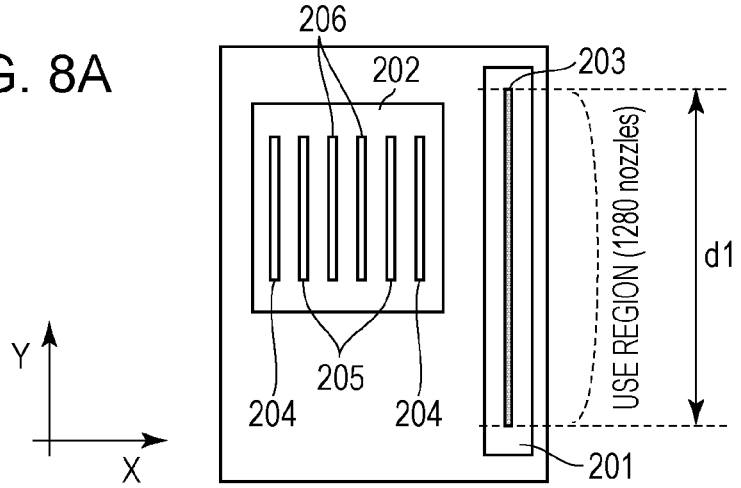
FIGS. 8A to 8C are illustrations for describing printing modes executable in the embodiment.
Figure 8B:
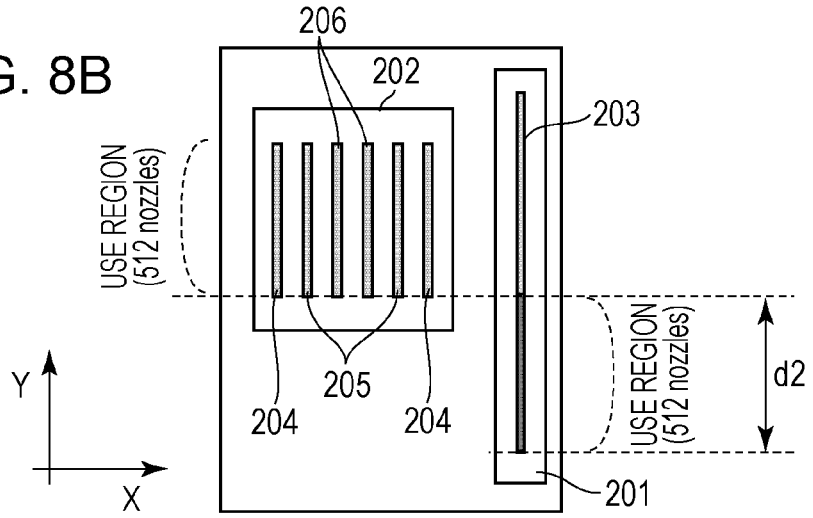
Figure 8C:
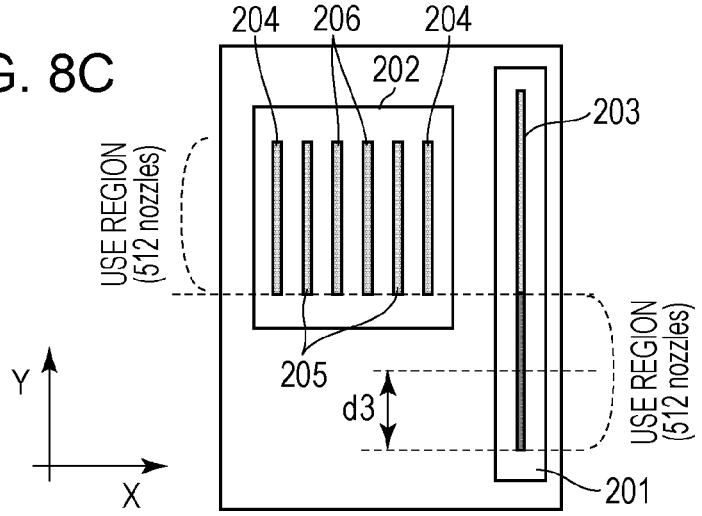

FIGS. 8A to 8C are illustrations for describing a printing method in executable modes according to the present embodiment.

FIG. 8A schematically illustrates a printing method when monochrome print data is input in one-pass printing mode. In this case, a unit region in a printing medium is a region having a distance d1 corresponding to the length of the 1,280 nozzles in the Bk nozzle row 203 in the Y direction. In one scan of the print head, all of the 1,280 nozzles arranged in the Bk nozzle row 203 is made available, and ink is discharged in accordance with print data. None of the Cl nozzle rows 204 to 206 is used. After the completion of this scan, the printing medium is conveyed by the distance d1 in the Y direction. Then, discharging the black ink in accordance with the print data from the 1,280 available nozzles with scanning of the print head and conveying the print data by the distance d1 in the Y direction are alternately repeated, and the image is printed for all the unit regions in the printing medium.

FIG. 8B schematically illustrates a printing method when color print data is input in one-pass printing mode. In this case, among the 1,280 nozzles arranged in the Bk nozzle row 203, 512 nozzles in an upstream end portion in the Y direction are used in printing. All of the nozzles in the C nozzle rows 204, M nozzle rows 205, and Y nozzle rows 206 are used in printing.

Figure 9:
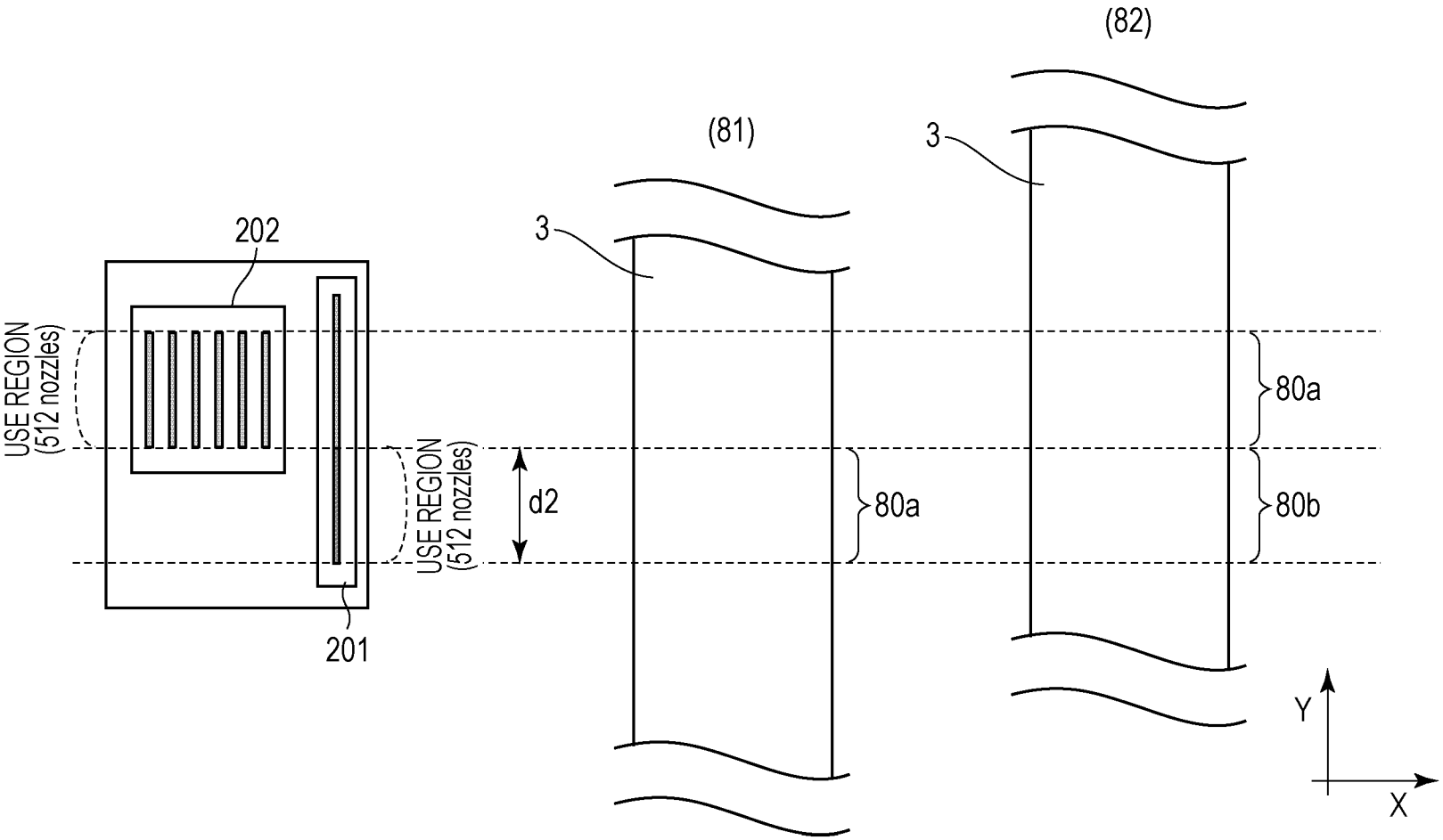
FIG. 9 is an illustration for describing a one-pass printing mode according to the embodiment.

FIG. 9 is an illustration for describing a printing process when an image is printed in accordance with the printing method in the case where color print data is input in one-pass printing mode.

A unit region in the printing medium in this case is a region having a distance d2 corresponding to the length of the 512 nozzles in the Bk nozzle row 203 in the upstream end portion in the Y direction.

In an actual printing method, when the printing medium is in a location (81) where the 512 nozzles in the use region in the Bk nozzle row 203 and a unit region 80*a* in the printing medium 3 are opposed to each other, the black ink is discharged from the 512 nozzles in the use region in the Bk nozzle row 203 to the unit region 80*a* while one scan of the print head is performed. Next, the printing medium 3 is conveyed by the distance d2 toward the downstream side in the Y direction. This conveys the printing medium to a location (82) where the unit region 80*a* is opposed to the C nozzle rows 204, M nozzle rows 205, and Y nozzle rows 206. After the conveyance, the print head is scanned, and chromatic color ink is discharged to the unit region 80*a*. In the scan in the location (82), the black ink is discharged to a unit region 80*b*, which is adjacent to the unit region 80*a* on the downstream side in the Y direction. After that, discharging the black ink to a unit region together with scanning of the print head, discharging the chromatic color ink to another unit region adjacent to the above unit region on the downstream side in the Y direction, and conveying the printing medium by the distance d2 in the Y direction are alternately repeated, and the image is printed over the printing medium.

In printing illustrated in FIG. 9, for each unit region, printing with the black ink is first performed, and then printing with the chromatic color ink is performed in the next scan. Accordingly, there is a time lag corresponding to one scan between the application of the black ink and that of the chromatic color ink, and blur between the black ink and the chromatic color ink can be prevented.

FIG. 8C schematically illustrates a printing method when color print data is input in two-pass printing mode.

In this case, all of the 512 nozzles in the Bk nozzle row 203 on the upstream side in the Y direction and the nozzles in the Cl nozzle rows (C nozzle rows 204, M nozzle rows 205, and Y nozzle rows 206) are made available, as in the case illustrated in FIG. 8B. A unit region in this case is a region having a distance d3 corresponding to the length of 256 nozzles in the Y direction out of the 512 nozzles in the use region in the Bk nozzle row on the upstream side in the Y direction. In this case, the image is printed in accordance with the print data by discharging the ink to each of the unit regions such that, in sequence, the black ink is discharged from the 256 nozzles on the upstream side in the Y direction out of the 512 nozzles in the use region in the Bk nozzle row together with scanning, the black ink is discharged from the 256 nozzles on the downstream side in the Y direction out of the 512 nozzles in the use region in the Bk nozzle row together with scanning, the chromatic color ink is discharged from the 256 nozzles on the upstream side in the Y direction out of the 512 nozzles in the use region in each of the Cl nozzle rows 204 to 206 together with scanning, and the chromatic color ink is discharged from the 256 nozzles on the downstream side in the Y direction out of the 512 nozzles in the use region in each of the Cl nozzle rows 204 to 206 together with scanning. The printing medium is conveyed by the distance d3 toward the downstream side in the Y direction between the scans.

In this manner, the image can be printed for a unit region in the printing medium by discharging the same color of ink together with two scans.

FIG. 8C illustrates the two-pass printing mode. In five-pass printing mode and seven-pass printing mode, an image is printed by substantially the same operation as in the two-pass printing mode, except for the number of scans carried out to complete printing.

In the present embodiment, when there is a predetermined region where cockling is estimated to occur in front-side printing, printing is performed in a region on the back side corresponding to the predetermined region by scanning the print head only in one direction, and the occurrence of ink landing position deviation is suppressed.

Figure 10A:
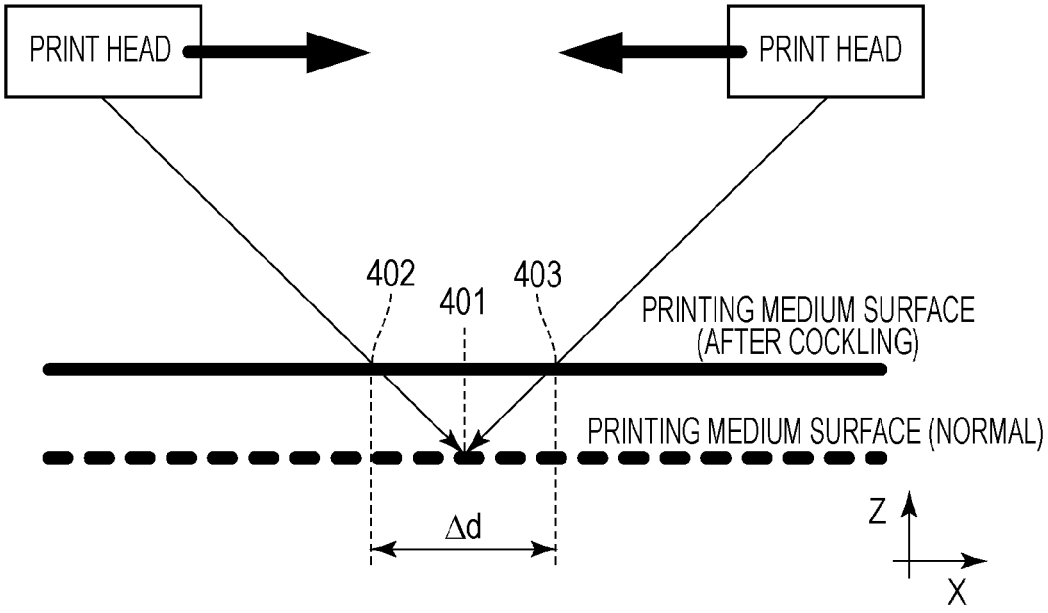
FIGS. 10A to 10C are illustrations for describing a mechanism for suppressing ink landing position deviation.
Figure 10B:
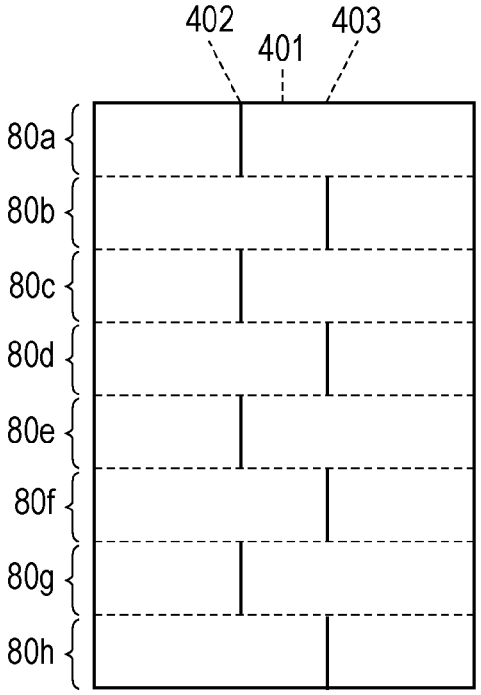
Figure 10C:
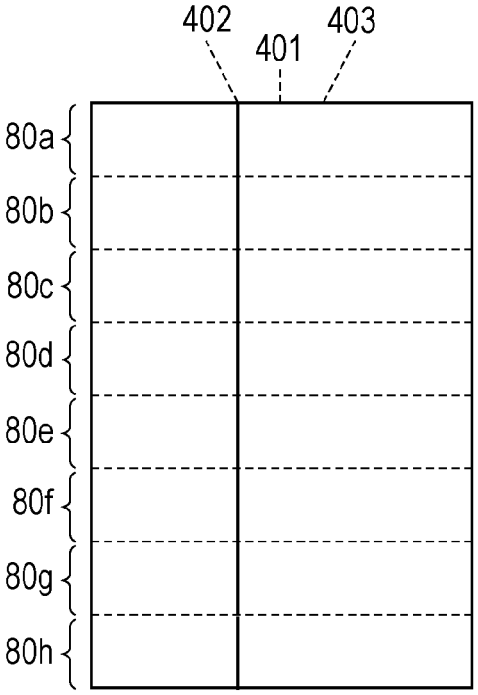

FIG. 10A is an illustration for describing ink landing position deviation appearing when cockling occurs. FIG. 10B schematically illustrates one example of an image formed in printing of alternately repeating scanning in a forward direction and scanning in a backward direction along the X direction (bidirectional printing) when cockling occurs. FIG. 10C schematically illustrates one example of an image formed in printing of scanning only in either one of the forward direction or the backward direction along the X direction (unidirectional printing) when cockling occurs.

When ink is discharged while the print head is scanned, the scanning speed of the print head has an effect on the ink, and the ink is discharged in a direction inclined toward the Z direction, which is substantially perpendicular to the XY plane. In a case where the ink is applied to a location 401, typically, the print head controls its discharging timing such that the ink is discharged before the print head is moved to a location opposed to the location 401. In bidirectional printing, as illustrated in FIG. 10A, the discharging timing is controlled in each of discharging in the forward direction and discharging in the backward direction. This enables the ink to land in the same location 401 in scanning in both directions.

When cockling occurs in the printing medium, the distance between the print head and the printing medium is reduced. Thus, when the ink is discharged so as to be aimed at the location 401 by scanning in the forward direction (from the upstream side to the downstream side in the X direction), the ink lands in a location 402, which deviates from the location 401 on the upstream side in the X direction. When the ink is discharged so as to be aimed at the location 401 by scanning in the backward direction (from the downstream side to the upstream side in the X direction), similarly, the ink lands in a location 403, which deviating from the location 401 on the downstream side in the X direction. Thus, when cockling occurs, although the ink is aimed at the same location 401 by scanning in the forward direction and scanning in the backward direction, there is a distance Δd in the landing position deviation between the scans.

The case where a ruled line is printed in the location 401 on the printing medium is described with reference to FIGS. 10B and 10C.

In bidirectional printing in one pass for the unit regions 80*a* to 80*h* in the printing medium, the ink is discharged to the unit regions 80*a*, 80*c*, 80*e*, and 80*g* by scanning in the forward direction, and the ink is discharged to the unit regions 80*b*, 80*d*, 80*f*, and 80*h* by scanning in the backward direction. When cockling occurs in the printing medium, the ink lands in the location 402 in the unit regions 80*a*, 80*c*, 80*e*, and 80*g* and the ink lands in the location 403 in the unit regions 80*b*, 80*d*, 80*f*, and 80*h*, as illustrated in FIG. 10B. Because the ruled line is printed in the neighboring unit regions in the Y direction such that it is displaced by Δd in the X direction, the decrease in image quality is noticeable.

In unidirectional printing in one pass for the unit regions 80*a* to 80*h* in the printing medium, as illustrated in FIG. 10C, because printing is performed by scanning in the forward direction in all of the unit regions 80*a* to 80*h*, the ink lands in the location 402. As is clear from FIG. 10C, even if cockling occurs, the decrease in the image quality of the ruled line image can be suppressed by unidirectional printing.

In view of the above described respects, in the present embodiment, the scanning condition in back-side printing is determined in accordance with the amount of ink discharged to a unit region in the printing medium in front-side printing, and the print head is scanned in accordance with the scanning condition determined for each unit region. Specifically, in printing a unit region on the back side of the printing medium corresponding to a unit region on the front side where the amount of ink discharged in printing is large, the print head is scanned in the same direction as in the previous scan. This can suppress the decrease in the image quality caused by landing position deviation even when cockling occurs in front-side printing.

A printing control method used in double-sided printing in the present embodiment is described in detail below.

When double-sided printing is performed on plain paper by a small number of scans, cockling is likely to occur in front-side printing, and this may cause ink landing position deviation in back-side printing. In the present embodiment, in the case of the printing condition that the type of the printing medium is plain paper, the printing quality is "standard," and the double-sided printing is selected, among the printing conditions illustrated in FIG. 7, the scanning direction of the print head in back-side printing is controlled in accordance with the amount of ink discharged on the front side. The case where color print data is input in one-pass printing mode illustrated in FIG. 8B is described in detail below.

Figure 11A:
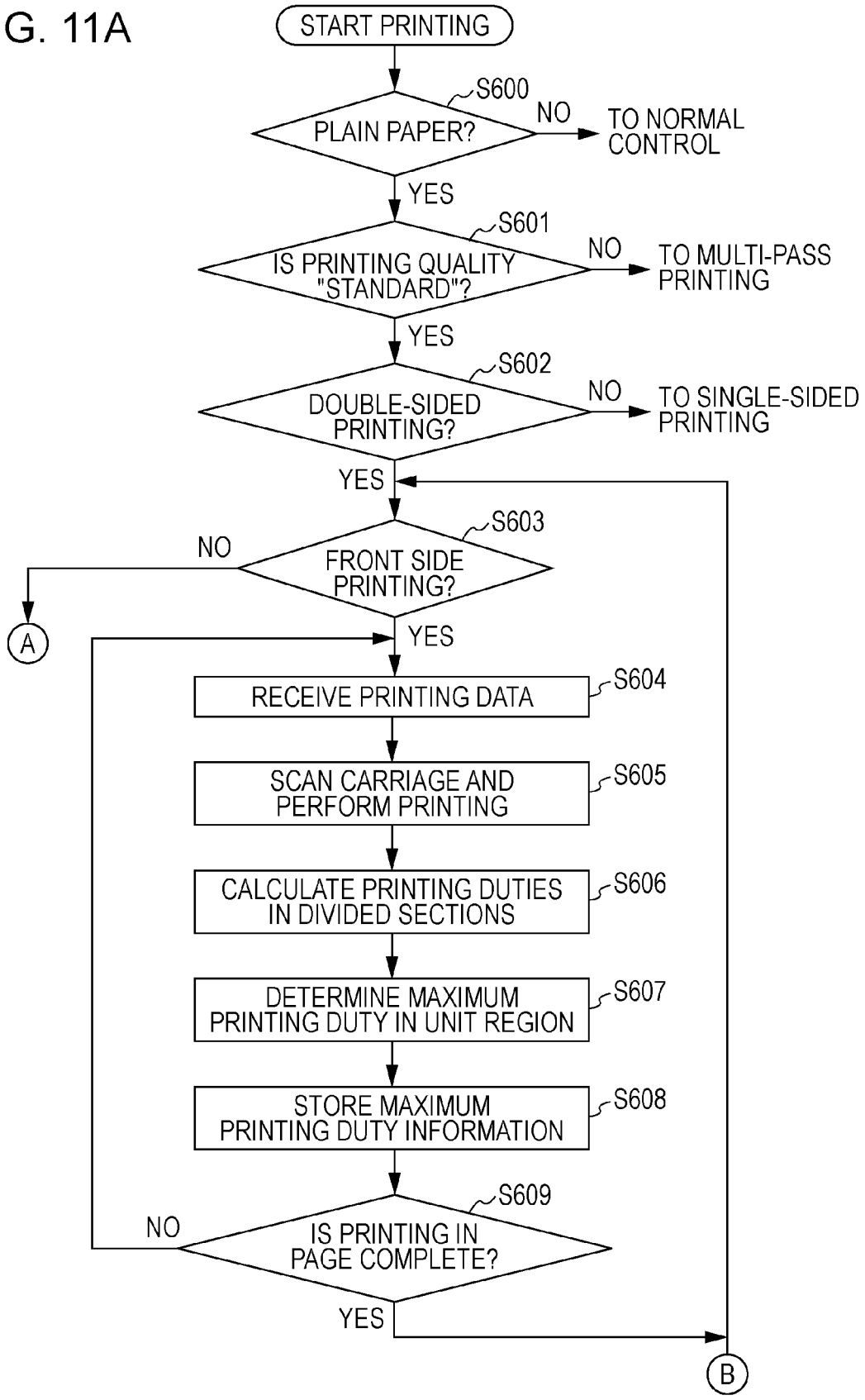
FIGS. 11A and 11B are flowcharts that illustrate a double-sided printing method according to the embodiment.
Figure 11B:
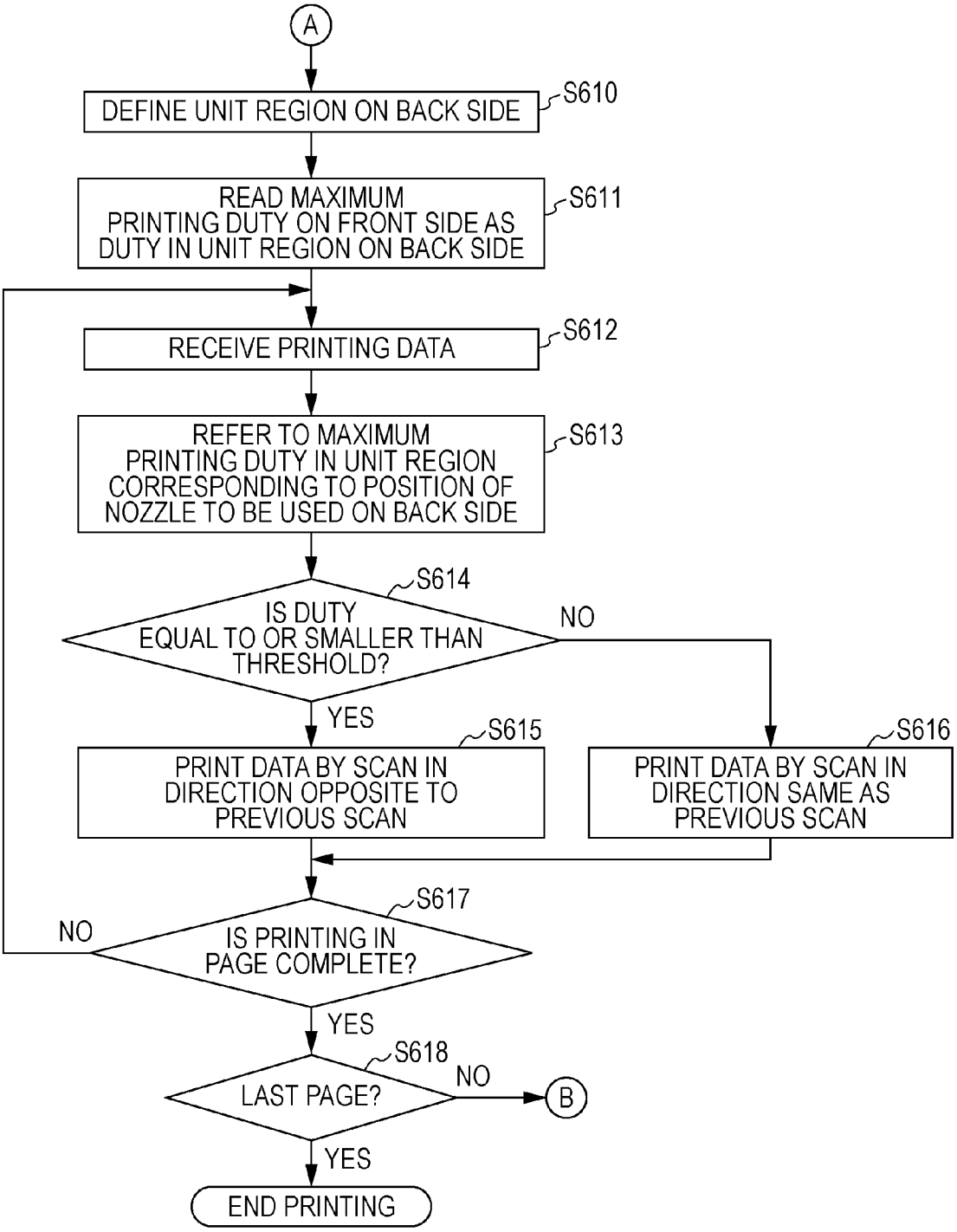
Figure 12A:
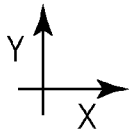
FIGS. 12A to 12C are illustrations for describing the double-sided printing method according to the embodiment.
Figure 12B:
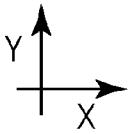
Figure 12C:
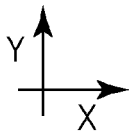

FIGS. 11A and 11B are flowcharts that illustrate a print control flow in double-sided printing in the present embodiment. FIGS. 12A to 12C are illustrations for describing a process in executing the double-sided printing control illustrated in FIGS. 11A and 11B when an example of print data is input.

After an instruction to execute a printing job is received, it is determined whether a printing medium is plain paper or not (S600). When the printing medium is plain paper, the processing proceeds to S601. When the printing medium is not the plain paper, because cockling is unlikely to occur, control for the bidirectional printing of alternately repeating scanning in the forward direction and scanning in the backward direction is performed.

Next, it is determined whether the printing quality is "standard" or not (S601). When the printing quality is "standard," the processing proceeds to S602. When the number of passes for a unit region in the printing medium is large, even when cockling occurs, the effect of ink landing position deviation can be suppressed. Accordingly, when the printing quality is "high," the control for the bidirectional printing is performed.

Next, it is determined whether the printing job is the double-sided printing or not (S602). When the printing job is the double-sided printing, the processing proceeds to S603. When the printing job is the single-sided printing, normal bidirectional printing is performed. The front side in the present embodiment indicates a side subjected to printing at the first time in double-sided printing, and the back side indicates a side subjected to printing at the second time.

It is determined whether the side to be subjected to the next printing is the front side or not (S603). When the front side is to be subjected to the next printing, print data is received (S604), and ink is discharged to a unit region on the front side in accordance with the print data while scanning the print head for the unit region in the printing medium (S605).

Next, a plurality of divided sections obtained by dividing the unit region on the front side of the printing medium are defined, and information about the printing duty in each of the divided sections is obtained (S606). Here, the printing duty corresponds to the amount of ink discharged per unit area, and in the present embodiment, the printing duty when ink of 12 ng is applied at 600 dpi is defined as 100%. In the present embodiment, the printing duty is calculated based on the dot number N printed on the printing medium. Here, because the amount of black ink discharged is approximately twice that of chromatic color ink discharged, a weight twice that to the dot number Nc of the chromatic color ink is assigned to the dot number Nb of the black ink. Specifically, the dot number N is calculated based on Equation 1, and on the assumption that the printing duty when the dot number N corresponds to two dots at 600 dpi is defined as 100%, the printing duty is calculated.

$$N=(Nb\times 2)+Nc \quad \text{(Eq. 1)}$$

FIG. 12A is a schematic diagram for describing a method for calculating the printing duty for each divided section 91 in S606 in an example case where an example of print data is input. Each of unit regions 90*a* to 90*j* has the same length as the length d2 of the 512 nozzles in the use region in the Bk nozzle row 203 in the Y direction illustrated in FIG. 8B.

In the scan at the first time, the black ink is discharged to the unit region 90*a* from the nozzles in the Bk nozzle row 203. In the scan at the second time, the black ink is discharged to the unit region 90*b* from the nozzles in the Bk nozzle row 203, and the chromatic color ink is discharged to the unit region 90*a* from the nozzles in the Cl nozzle rows 204 to 206. After that, similarly, the black ink is discharged to each of the unit regions 90*c* to 90*j* in the N-th scan, and the chromatic color ink is discharged thereto in the (N+1)-th scan.

In the present embodiment, each of the unit regions 90*a* to 90*j* is logically divided into the plurality of divided sections 91, and the printing duty is calculated for each of the divided sections 91. Each of the divided sections has the length corresponding to the 320 dots in the X direction and the length corresponding to the 288 dots in the Y direction at 600 dpi.

FIG. 12A illustrates an example in which the printing duties in the divided sections 91 when an example of print data is input are indicated by the numerical values in the divided sections 91 represented by the grating. For example, the printing duties in the divided sections 91 in the unit region 90*a* are 140%, 120%, 120%, 0%, and 0% in sequence from the upstream side in the X direction. The printing duties in the divided sections 91 in the unit region 90*c* are 50%, 60%, 20%, 0%, and 0% in sequence from the upstream side in the X direction.

Next, the maximum printing duty (maximum value of the printing duties) among the printing duties in the plurality of divided sections in each of the unit regions 90*a* to 90*j* is calculated (S607).

FIG. 12B is a schematic diagram for describing a method for calculating the maximum printing duty in S607 when the print data used as an example in FIG. 12A is input.

In this example case, the maximum printing duty in the unit region 90*a* is 140%, which is the printing duty in the divided section on the most upstream side in the X direction. The maximum printing duty in the unit region 90*c* is 60%, which is the printing duty in the second divided section on the upstream side in the X direction. The maximum printing duty in each of the unit regions calculated in this way is stored in the RAM 305, which is a storage area in the inkjet printing apparatus (S608).

Next, it is determined whether printing in one page of the printing medium by printing together with scanning of the print head performed in S605 is completed or not (S609). When it is determined that the printing is not completed, the processing returns to S604, and the same processing is performed for the next scan on the front side. When it is determined that the printing is completed, the processing returns to S603, and it is determined whether the side to be subjected to the next printing is the front side or not.

When it is determined in S603 that the back side is to be subjected to the next printing, first, a unit region on the back side is defined (S610). Specifically, the unit regions on the back side in positions corresponding to the unit regions 90*a* to 90*j* defined on the front side (positions right back of the unit regions on the front side) are defined as unit regions 90*a*' to 90*j*'.

Next, the values of the maximum printing duties in the unit regions 90*a* to 90*j* in front-side printing stored in the RAM 305 in S609 are read for the unit regions 90*a*' to 90*j*' on the back side (S611). After that, the print data is received (S612). Then, before scanning the print head for each of the unit regions 90*a*' to 90*j*', the maximum printing duties in the corresponding unit regions 90*a* to 90*j* on the front side read in S611 are referred to (S613).

It is determined whether the maximum printing duty in front-side printing is equal to or smaller than a threshold for each of all the unit regions in the positions opposed to the use regions in the nozzle rows in the print head (S614). In the present embodiment, the printing duty 130% is set as the threshold. When the printing duty is not larger than the threshold, the ink is discharged while the print head is scanned in a direction opposite to the scanning direction in the previous scan (S615). When the printing duty is larger than the threshold, the ink is discharged while the print head is scanned in the same direction as the scanning direction in the previous scan (S616). The details of the processing in S614 to S616 are described below.

When one scan on the back side is completed, it is determined whether printing in one page of the printing medium is completed or not (S617). When it is determined that the printing is not completed, the processing returns to S612, and the same processing is performed for the next scan on the back side. When it is determined that the printing is completed, it is determined whether printing to the last page is completed or not (S618). When it is determined that the printing is not completed, the processing returns to S603, and it is determined whether the side to be subjected to the next printing is the front side or not. When it is determined that the printing is completed, the printing job ends.

FIG. 12C is a schematic diagram for describing a method for determining the scanning direction in S614 to S616 when the print data used as an example in FIG. 12A is input. The arrows in the unit regions 90*a*' to 90*j*' illustrated in FIG. 12C schematically indicate the scanning directions when the unit regions and the Bk nozzle row 203 are in opposed positions.

In the printing mode corresponding to the use ranges of the nozzles illustrated in FIG. 8B, first, the Bk nozzle row 203 and the unit region 90*a*' are in opposed positions in the first scan. In the first scan, because there is no previous scan, the scan may be in any direction along the X direction. Here, as an example, the ink is discharged while the print head is scanned from the upstream side to the downstream side in the X direction.

Then, in the second scan, the Bk nozzle row 203 and the unit region 90*b*' are in opposed positions, and the Cl nozzle rows 204 to 206 and the unit region 90*a*' are in opposed positions. The maximum printing duties in the unit regions 90*a* and 90*b* on the front side are 140% and 80%, respectively. That is, because the maximum printing duty in the unit region 90*a* is higher than the threshold 130%, the processing proceeds to S616, and the carriage is temporarily moved in the opposite direction. At this time, no ink is discharged. Then, the ink is discharged while the print head is scanned in the same direction as in the first scan (from the upstream side to the downstream side in the X direction). After that, to perform a scan in the same direction as in the previous scan, an idle scan, which is a scan of temporarily moving the carriage to the opposite side without discharging ink, is executed.

Then, in the third scan, the Bk nozzle row 203 and the unit region 90*c*' are in opposed positions, and the Cl nozzle rows 204 to 206 and the unit region 90*b*' are in opposed positions. The maximum printing duties in the unit regions 90*b* and 90*c* on the front side are 80% and 60%, respectively. That is, because the maximum printing duty in each of the unit regions 90*b* and 90*c* is smaller than the threshold 130%, the processing proceeds to S615, and the ink is discharged while the print head is scanned in the direction opposite to that in the second scan (from the downstream side to the upstream side in the X direction).

After that, the scanning direction in each scan is controlled in the same manner. When the print data illustrated in FIG. 12A is input, as is clear from FIG. 12C, in the second and fourth to seventh scans, printing is performed while the print head is scanned in the same direction as in the previous scan, and in the third and eighth to tenth scans, printing is performed while the print head is scanned in the direction opposite to that in the previous scan.

In the above-described configuration, when the amount of ink discharged on the front side is large and there is a high possibility that cockling is occurring in a unit region, the print head is scanned in the same direction as in the previous scan to perform printing in a unit region on the back side corresponding to that unit region on the front side. This can suppress a decrease in the image quality caused by landing position deviation.

When the amount of ink discharged on the front side is small and there is a low possibility that cockling is occurring in a unit region, the print head is scanned in the direction opposite to that in the previous scan to perform printing in a unit region on the back side corresponding to that unit region on the front side. This can improve the throughput.

Second Embodiment

The first embodiment illustrates the form in which the scanning direction of the print head is the scanning condition and the print head is scanned in the same direction as in the previous scan to perform printing in a unit region on the back side corresponding to a unit region where the amount of ink discharged in front-side printing is large.

In contrast to this, the present embodiment illustrates a form in which a scanning speed of the print head is the scanning condition and the print head is scanned at a speed slower than that in the previous scan to perform printing in a unit region on the back side corresponding to a unit region where the amount of ink discharged in front-side printing is large.

The same portions as in the above-described first embodiment are not described here.

In the present embodiment, the occurrence of ink landing position deviation is suppressed by reducing the scanning speed of the print head in printing in a unit region on the back side corresponding to a unit region on the front side where cockling is estimated to occur in front-side printing.

Figure 13A:
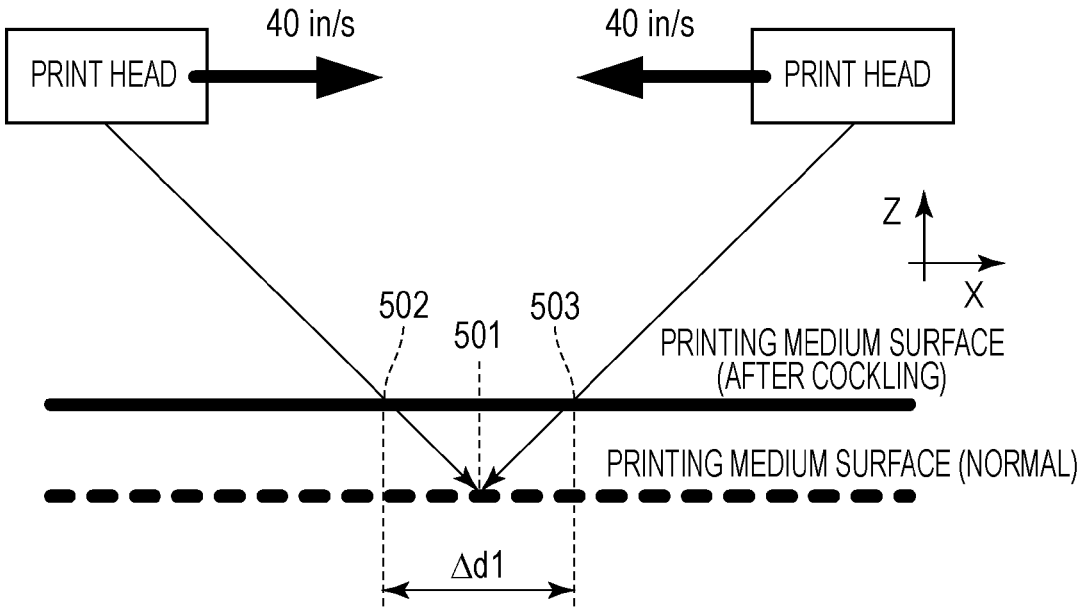
FIGS. 13A and 13B are illustrations for describing a mechanism for suppressing ink landing position deviation.
Figure 13B:
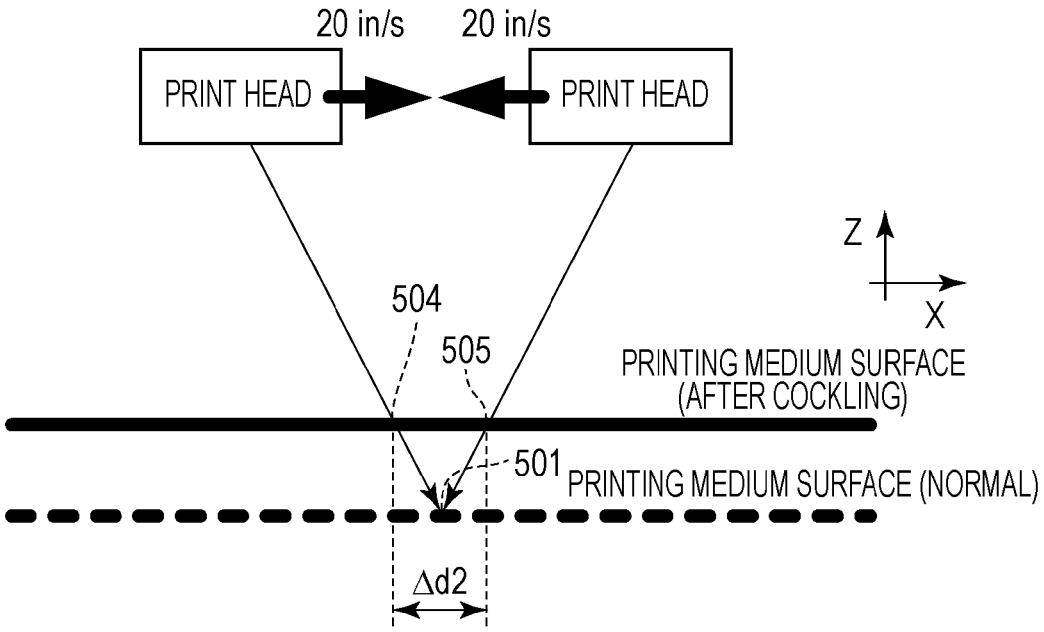

FIG. 13A is an illustration for describing ink landing position deviation appearing when cockling occurs in a case where the scanning speed is relatively high. FIG. 13B is an illustration for describing ink landing position deviation appearing when cockling occurs in a case where the scanning speed is relatively low.

When the scanning speed of the print head is relatively low (20 in/s), the X-direction component in the ink discharge speed in each of the forward direction and the backward direction is slower than that when the scanning speed of the print head is relatively high (40 in/s). Thus, the discharge timing when the ink is applied to a position 501 in the case where the scanning speed of the print head is relatively low lags behind that when the ink is applied to the position 501 in the case where the scanning speed of the print head is relatively high. Accordingly, when cockling occurs, an ink landing position deviation distance Δd2 between an ink landing position 504 in the forward direction and an ink landing position 505 in the backward direction when the scanning speed of the print head is low is shorter than an ink landing position deviation distance Δd1 between an ink landing position 502 and an ink landing position 503 when the scanning speed of the print head is high.

The difference (Δd1−Δd2) between the ink landing position deviation distance Δd1 for a high scanning speed (V1) and the ink landing position deviation distance Δd2 for a low scanning speed (V2) can be calculated from Equation 2.

$$\Delta d1-\Delta d2=(V1-V2)\times 2L/v \quad \text{(Eq. 2)}$$

where L is the distance between the surface of the print head and the printing medium surface (=1.0 mm), and v is the discharge speed of ink droplets (=15 m/s).

In the above-described manner, the difference between the landing position deviation in a scan in the forward direction and that in a scan in the backward direction when cockling occurs can be reduced by using a reduced scanning speed of the print head.

A printing control method used in double-sided printing in the present embodiment is described in detail below.

Figure 14A:
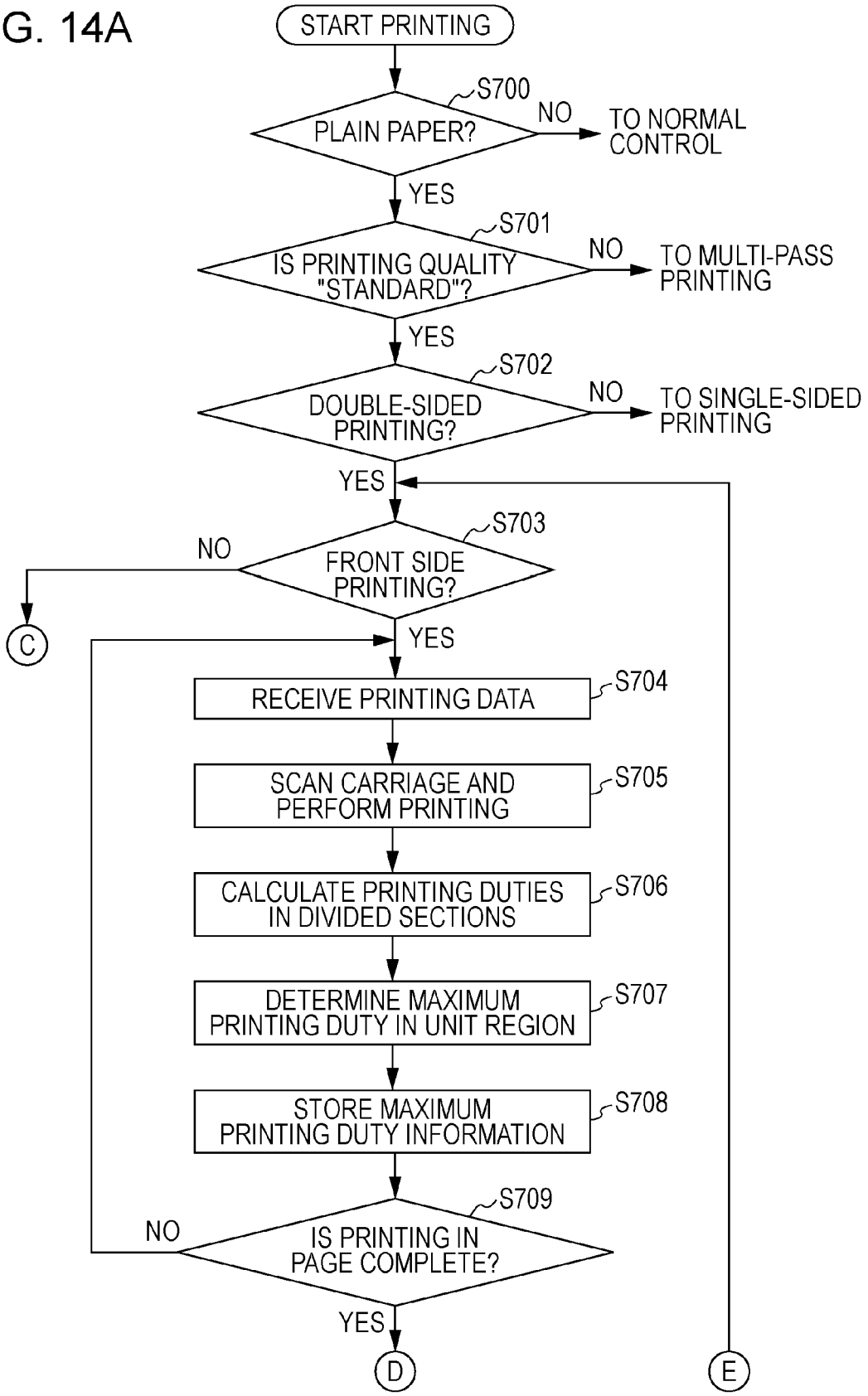
FIGS. 14A and 14B are flowcharts that illustrate a double-sided printing method according to an embodiment.
Figure 14B:
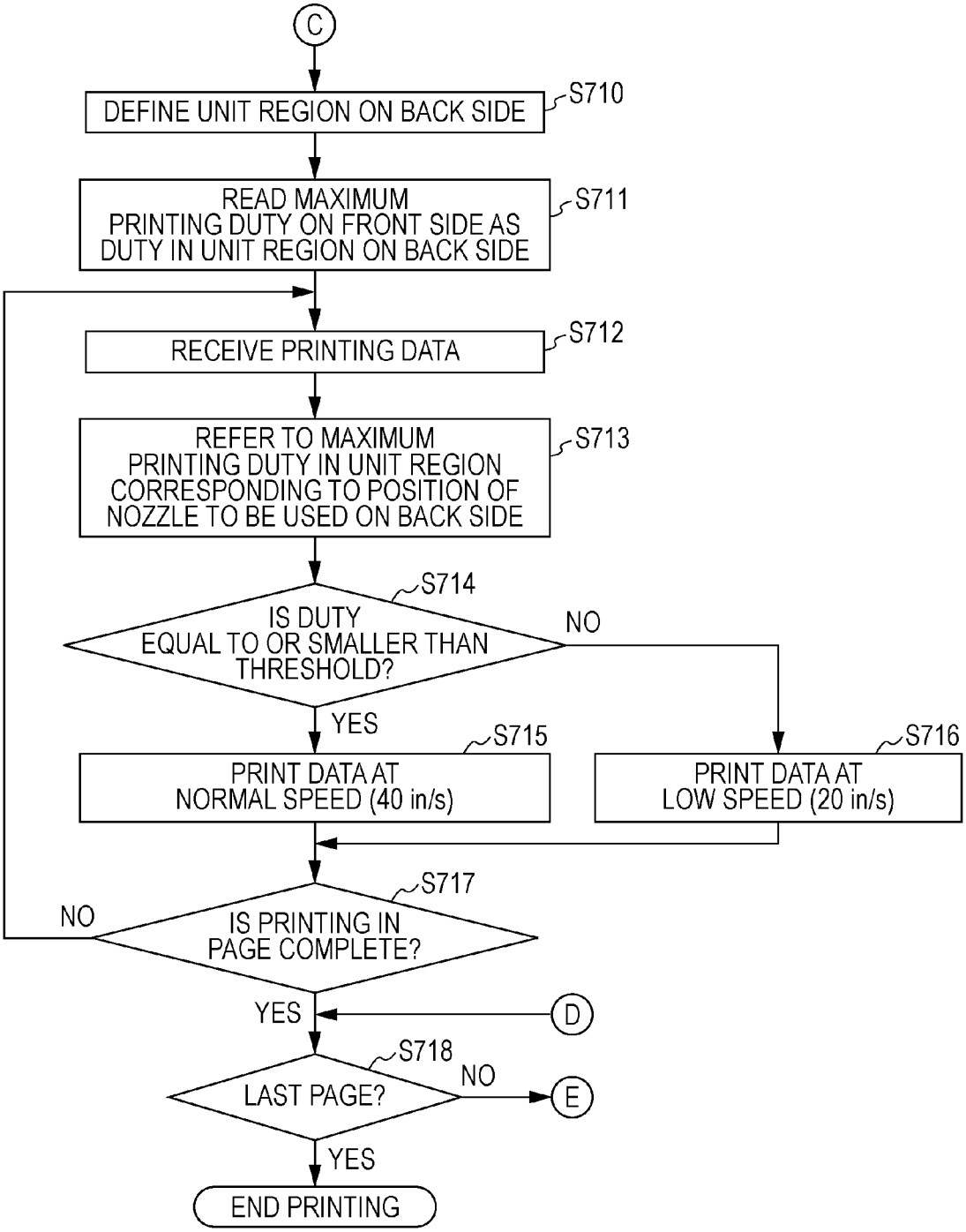

FIGS. 14A and 14B are flowcharts that illustrate a print control flow in double-sided printing in the present embodiment.

Steps S700 to S714, S717, and S718 illustrated in FIGS. 14A and 14B are the same as steps S600 to S614, S617, and S618 illustrated in FIGS. 11A and 11B, and they are not described here.

In step S715, the maximum printing duty in front-side printing is equal to or smaller than the threshold (130%), and the ink is discharged while scanning is performed at a normal speed (40 in/s). In step S716, where the maximum printing duty in front-side printing is larger than the threshold and there is a possibility that cockling is occurring, the ink is discharged while scanning is performed at a lower speed (20 in/s) than the normal speed.

The difference (Δd1−Δd2) between the ink landing position deviation for a high scanning speed in the present embodiment and that for a low scanning speed is approximately 68 μm, which is calculated from the above-described Equation 2 where V1 is 40 in/s, V2 is 20 in/s, L is 1.0 mm, and v is 15 m/s.

The above-described configuration can achieve printing capable of both suppressing a decrease in image quality caused by landing position deviation when cockling occurs and improving the throughput.

The above-described embodiments illustrate the forms in which the effect of landing position deviation is suppressed only when plain paper, in which cockling is likely to occur, is used. Other forms may also be used. That is, the above-described control may be carried out when other types of printing media, such as post cards or photo paper, are used.

The above-described embodiments illustrate the forms in which the effect of landing position deviation is suppressed in one-pass printing mode, at which ink landing position deviation is easily noticeable when cockling occurs. Other forms may also be used. For example, the above-described control may be carried out in two-pass printing mode, five-pass printing mode, and seven-pass printing mode in the present embodiment.

The above-described embodiments illustrate the forms in which when color print data is input in one-pass printing mode, the nozzles to be used are determined such that the use region in the Cl nozzle rows and the use region in the Bk nozzle row do not overlap in the Y direction, as illustrated in FIG. 8B. Other forms may also be used. For example, a form that employs the 512 nozzles in each of the Cl nozzle rows and the 512 nozzles in the Bk nozzle row lying in the same position as the Cl nozzle rows in the Y direction may also be used. In this case, in a scan at the same time, the nozzles in the use regions in the Bk nozzle row and the Cl nozzle rows are opposed to the same unit region. Accordingly, in comparison between the maximum printing duty in front-side printing and the threshold (S614, S714), only the maximum printing duty in front-side printing in a single unit region may be obtained in each scan.

The above-described embodiments illustrate the forms in which a single MPU performs processing for controlling printing on the front side of a printing medium, processing for acquiring information about the amount of ink discharged to each divided section, processing for determining a scanning condition for the back side of the printing medium, and processing for controlling printing on the back side of the printing medium. Other forms may also be used. For example, a form in which a unit configured to perform processing for controlling printing on the front side of a printing medium, a unit configured to perform processing for acquiring information about the amount of ink discharged to each divided section, a unit configured to perform processing for determining a scanning condition for the back side of the printing medium, and a unit configured to perform processing for controlling printing on the back side of the printing medium are included as different components may also be used.

The above-described embodiments illustrate the forms in which when the maximum printing duty is calculated among the printing duties in the plurality of divided sections in a unit region and the maximum printing duty is used as a parameter for estimating cockling. Other forms may also be used. For example, a form that employs a calculated average value of the printing duties in the plurality of divided sections in a unit region as a parameter for estimating cockling may also be used.

The inkjet printing apparatus, inkjet printing method, and program according to the present invention can achieve printing capable of suppressing the effect of ink landing position deviation caused by the occurrence of partial cockling in double-sided printing.

While the present invention has been described with reference to exemplary embodiments, it is to be understood that the invention is not limited to the disclosed exemplary embodiments.

This application claims the benefit of Japanese Patent Application No. 2014-170987, filed Aug. 25, 2014, which is hereby incorporated by reference herein in its entirety.

What is claimed is:

1. An inkjet printing apparatus comprising:

a print head including nozzle rows each including a plurality of nozzles for discharging ink of a same color arranged in a predetermined direction;

a scanning unit configured to scan each of a plurality of unit regions in a printing medium with the print head in a forward direction and a backward direction of a crossing direction that crosses the predetermined direction, the backward direction being opposite to the forward direction;

a first print control unit configured to cause the print head to discharge ink to each of the plurality of unit regions in a first surface of the printing medium, while the scanning unit scans with the print head;

an acquiring unit configured to acquire information about an amount of ink discharged to each of a plurality of divided sections of each of the plurality of unit regions on the first surface;

a determining unit configured to determine a scanning direction out of the forward direction and the backward direction for each of the plurality of unit regions in a second surface, the second surface being a back side of the first surface of the printing medium, based on the information about the amount of ink discharged to each of the plurality of divided sections of each of the plurality of unit regions on the first surface; and a second print control unit configured to cause the print head to discharge the ink to each of the plurality of unit regions in the second surface while the scanning unit scans with the print head in the determined scanning direction.

2. The inkjet printing apparatus according to claim 1, wherein the acquiring unit is configured to acquire information about a representative value of the amounts of ink discharged to the plurality of divided sections in a predetermined unit region out of the unit regions in the first surface, and the determining unit is configured to determine the scanning direction, based on the representative value of the amounts of ink discharged indicated by the information.

3. The inkjet printing apparatus according to claim 2, wherein the plurality of unit regions include at least a first unit region and a second unit region, the second unit region being adjacent to the first unit region in the predetermined direction and being subjected to be printed subsequently to the first unit region in the printing by the second print control unit, and the determining unit is configured to determine the scanning direction for each of the first and second unit regions in the second surface such that (i) when the representative value of the amounts of ink discharged to the second unit region is a first value, the scanning unit scans the print head in different directions for the first and second unit regions and (ii) when the representative value of the amounts of ink discharged to the second unit region is a second value larger than the first value, the scanning unit scans the print head in an identical direction for the first and second unit regions.

4. The inkjet printing apparatus according to claim 3, wherein the acquiring unit is configured to acquire information about a type of the printing medium to be printed onto, and the determining unit is configured to determine the scanning direction for each of the first and second unit regions in the second surface such that (i) when the type of the printing medium is plain paper and the representative value of the amounts of ink discharged to the second unit region is the first value, the scanning unit is configured to scan with the print head in different directions for the first and second unit regions, (ii) when the type of the printing medium is plain paper and the representative value of the amounts of ink discharged to the second unit region is the second value, the scanning unit is configured to scan with the print head in identical direction for the first and second unit regions, and (iii) when the type of the printing medium is other than plain paper, the scanning unit is configured to scan with the print head in different directions for the first and second unit regions.

5. The inkjet printing apparatus according to claim 3, wherein the acquiring unit is configured to acquire information about a number of scans by the scanning unit for each of the plurality of unit regions, and the determining unit is configured to determine the scanning direction for each of the first and second unit regions in the second surface such that (i) when the number of scans indicated by the acquired information is a first number and the representative value of the amounts of ink discharged to the second unit region indicated by the acquired information is the first value, the scanning unit is configured to scan with the print head in different directions for the first and second unit regions, (ii) when the number of scans is the first number and the representative value of the amounts of ink discharged to the second unit region is the second value, the scanning unit is configured to scan with the print head in identical directions for the first and second unit regions, and (iii) when the number of scans indicated by the acquired information is a second number larger than the first number, the scanning unit is configured to scan with the print head in different directions for the first and second unit regions.

6. The inkjet printing apparatus according to claim 2, wherein the acquiring unit is configured to acquire information about a maximum value of the amounts of ink discharged to the plurality of divided sections in the predetermined unit region as the information about the representative value.

7. The inkjet printing apparatus according to claim 2, wherein the acquiring unit is configured to acquire information about a average value of the amounts of ink discharged to the plurality of divided sections in the predetermined unit region as the information about the representative value.

8. The inkjet printing apparatus according to claim 1, wherein the nozzle rows in the print head include a first nozzle row in which a plurality of nozzles for discharging ink of a first color are arranged in the predetermined direction and a second nozzle row in which a plurality of nozzles for discharging ink of a second color different from the first color are arranged in the predetermined direction, and the acquiring unit is configured to acquire information about the amount of ink discharged to each of the plurality of divided sections, based on the amount of the ink of the first color and the amount of the ink of the second color discharged to each of the plurality of divided sections in the first surface in the printing by the first print control unit.

9. The inkjet printing apparatus according to claim 1, wherein the determining unit is configured to determine the scanning direction for each of the unit regions in the second surface, based on the amounts of ink discharged to the plurality of divided sections in positions corresponding to the plurality of divided sections in the first surface.

10. An inkjet printing method comprising:

a scanning step of scanning each of a plurality of unit regions in a printing medium with a print head including nozzle rows each including a plurality of nozzles for discharging ink of a same color arranged in a predetermined direction, in a forward direction and a backward direction of a crossing direction that crosses the predetermined direction, the backward direction being opposite to the forward direction;

a first printing step of causing the print head to discharge ink to each of the plurality of unit regions in a first surface of the printing medium, while scanning with the print head in the scanning step;

an acquiring step of acquiring information about an amount of ink discharged to each of a plurality of divided sections of each of the plurality of unit regions on the first surface;

a determining step of determining a scanning direction out of the forward direction and the backward direction for each of the plurality of unit regions in a second surface, the second surface being a back side of the first surface of the printing medium, based on the information about the amount of ink discharged to each of the plurality of divided sections of each of the plurality of unit regions on the first surface; and a second printing step of causing the print head to discharge the ink to each of the plurality of unit regions in the second surface while scanning with the print head in the determined scanning direction.

11. The inkjet printing method according to claim 10, wherein the acquiring step is configured to acquire information about a representative value of the amounts of ink discharged to the plurality of divided sections in a predetermined unit region out of the unit regions in the first surface, and the determining step is configured to determine the scanning direction, based on the representative value of the amounts of ink discharged indicated by the information.

12. The inkjet printing method according to claim 11, wherein the plurality of unit regions include at least a first unit region and a second unit region, the second unit region being adjacent to the first unit region in the predetermined direction and being subjected to printing subsequently to the first unit region in the printing by the second print control step, and the determining step configured to determine the scanning direction for each of the first and second unit regions in the second surface such that (i) when the representative value of the amounts of ink discharged to the second unit region is a first value, the scanning step scans the print head in different directions for the first and second unit regions and (ii) when the representative value of the amounts of ink discharged to the second unit region is a second value larger than the first value, the scanning step scans the print head in an identical direction for the first and second unit regions.

13. An inkjet printing apparatus comprising:

a print head including nozzle rows each including a plurality of nozzles for discharging ink of a same color arranged in a predetermined direction;

a scanning unit configured to scan each of a plurality of unit regions in a printing medium with the print head in a crossing direction that crosses the predetermined direction;

a first print control unit configured to cause the print head to discharge ink to each of the plurality of unit regions in a first surface of the printing medium, while the scanning unit scans with the print head;

an acquiring unit configured to acquire information about an amount of ink discharged to each of a plurality of divided sections of each of the plurality of unit regions on the first surface;

a determining unit configured to determine a scanning speed for each of the plurality of unit regions in a second surface, the second surface being a back side of the first surface of the printing medium, based on the information about the amount of ink discharged to each of the plurality of divided sections of each of the plurality of unit regions on the first surface; and a second print control unit configured to cause the print head to discharge the ink to each of the plurality of unit regions in the second surface while the scanning unit scans with the print head at the determined scanning speed.

14. The inkjet printing apparatus according to claim 13, wherein the acquiring unit is configured to acquire information about a representative value of the amounts of ink discharged to the plurality of divided sections in a predetermined unit region out of the unit regions in the first surface, and the determining unit is configured to determine the scanning speed, based on the representative value of the amounts of ink discharged indicated by the information.

15. The inkjet printing apparatus according to claim 14, wherein the determining unit is configured to determine the scanning speed for each of the first and second unit regions in the second surface such that (i) when the representative value of the amounts of ink discharged to the predetermined unit region out of the plurality of unit regions is a first value, the scanning unit is configured to scan with the print head at a first speed and (ii) when the representative value of the amounts of ink discharged to the predetermined unit region indicated by the acquired information is a second value larger than the first value, the scanning unit is configured to scan with the print head at a second speed slower than the first speed.

* * * * *